US007144271B1

(12) United States Patent
Burris et al.

(10) Patent No.: US 7,144,271 B1
(45) Date of Patent: Dec. 5, 2006

(54) SEALED TAMPER RESISTANT TERMINATOR

(75) Inventors: Donald Andrew Burris, Peoria, AZ (US); Brian L. Kisling, Phoenix, AZ (US); William B. Lutz, Glendale, AZ (US)

(73) Assignee: Corning Gilbert Inc., Glendale, AZ (US)

( * ) Notice: Subject to any disclaimer, the term of this patent is extended or adjusted under 35 U.S.C. 154(b) by 29 days.

(21) Appl. No.: 11/060,998

(22) Filed: Feb. 18, 2005

(51) Int. Cl.
*H01R 9/05* (2006.01)

(52) U.S. Cl. ..... 439/578; 439/583

(58) Field of Classification Search ..... 439/578, 439/583, 584; 174/88 C, 88 S; 385/87; 411/432

See application file for complete search history.

(56) References Cited

U.S. PATENT DOCUMENTS

| | | | | |
|---|---|---|---|---|
| 3,519,979 A | | 7/1970 | Bodenstein | 339/85 |
| 3,573,702 A | | 4/1971 | O'Keefe | 338/220 |
| 3,768,063 A | * | 10/1973 | Coffman | 439/135 |
| 3,845,454 A | | 10/1974 | Hayward | 339/85 |
| 3,890,028 A | | 6/1975 | Blanchenot | 339/85 |
| 4,469,386 A | | 9/1984 | Ackerman | 339/37 |
| 4,897,008 A | * | 1/1990 | Parks | 411/432 |
| 5,011,422 A | * | 4/1991 | Yeh | 439/307 |
| 5,055,060 A | | 10/1991 | Down | 439/304 |
| 5,106,312 A | | 4/1992 | Yeh | 439/133 |
| 5,179,877 A | | 1/1993 | Down | 81/443 |
| 5,273,444 A | | 12/1993 | Down | 439/133 |
| 5,435,736 A | | 7/1995 | McMills | 439/133 |
| 5,564,938 A | * | 10/1996 | Shenkal et al. | 439/301 |
| 5,655,915 A | | 8/1997 | McMills | 439/133 |
| 5,887,452 A | * | 3/1999 | Smith et al. | 66/170 |
| 6,089,912 A | * | 7/2000 | Tallis et al. | 439/584 |
| 6,491,546 B1 | | 12/2002 | Perry | 439/620 |
| 6,776,912 B1 | * | 8/2004 | Baurmeister | 210/646 |
| 6,887,103 B1 | * | 5/2005 | Montena et al. | 439/583 |

* cited by examiner

*Primary Examiner*—Alexander Gilman
(74) *Attorney, Agent, or Firm*—Marvin A. Glazer; Joseph M. Homa

(57) ABSTRACT

A tamper-resistant coaxial terminator includes an inner body rotatably captivated within an outer shield. A deformable portion of the inner body extends within an annular recess formed in the outer shield. An optional RF port, containing a resistor, is press-fit within the inner body. The RF port, or alternatively, the inner body, is internally-threaded for engaging the outer conductor of an equipment port. A seal ring extends over the outer conductor of the equipment port and is urged by the outer shield to directly engage the internally-threaded portion of the terminator. A seal is also optionally disposed between the outer shield and the inner body to minimize moisture induced corrosion. A shipping cap, usable at either end of the terminator, helps protect the terminator during shipment and prevents entry of debris.

22 Claims, 13 Drawing Sheets

SEALED TAMPER RESISTANT TERMINATOR

BACKGROUND OF THE INVENTION

1. Field of the Invention

The present invention relates generally to tamper resistant terminators and CATV coaxial connectors, and more particularly, to a tamper resistant terminator having an improved construction and sealing properties.

2. Description of the Related Art

Cable transmission systems are in wide use throughout the world for transferring television signals, and other types of signals, between devices. For example, a typical CATV system utilizes coaxial cables to provide signal communication between a head end and distributed receiver sets. A conventional CATV system includes a permanently installed cable extending from the head end throughout the area to be served. Various devices, such as directional taps, are spaced along the cable. Individual subscribers are serviced by a drop cable connected to a selected terminal of an equipment box or other device. The terminals that extend from the equipment box are externally threaded female coaxial ports designed to receive a conventional F-connector provided at the end of the drop cable. A terminator is affixed to each of the unused terminals of the equipment box to maintain proper impedance along the signal transmission path.

In some cases, the equipment box to which the drop cables are connected must be located in public areas, and the terminals may be readily accessible to the public. Such circumstances might permit unauthorized persons to move a drop cable from one port to another port, diverting service from a paying subscriber to a non-paying user. In an effort to prevent unauthorized access to the system, suppliers to the CATV industry have provided a type of terminator referred to as tamper-resistant or theft-proof. Typical examples of such tamper resistant terminators are shown and described in U.S. Pat. No. 3,845,454 (Hayward, et al.); U.S. Pat. No. 3,519,979 (Bodenstein); U.S. Pat. No. 4,469,386 (Ackerman); U.S. Pat. No. 5,055,060 (Down); U.S. Pat. No. 5,106,312 (Yeh); and U.S. Pat. No. 6,491,546 (Perry). A special tool, not generally available to the public, is required for installation and removal of such tamper resistant terminators from the equipment ports to which they are attached.

In addition, the terminals of the equipment box are often exposed to the elements. Tamper resistant terminators typically include metallic components, including an outer shell or shield intended to freely rotate about the remaining components housed therein. At least a portion of the outer shell fits closely around the internal components, but the outer shell must rotate relative to the other internal components in order for the terminator to function properly. Exposure to the elements, particularly moisture and rain, often results in corrosion of the internal components of the terminator. The result is that the outer shell locks up with the internal components whereby the entire terminator assembly can then be rotated as a unit, allowing an unauthorized person to remove the terminator without the need for any specialized tools. Some tamper-proof terminators allow for a seal to be made between the outer shell of the terminator and the female port device terminal.

Prior efforts to secure and seal such terminators have not proven to be entirely satisfactory. For example, some of such known terminators incorporate a relatively large number of components; the requirement for a relatively large number of parts, and related complex machining operations, cause the cost of production of such terminators to remain relatively high. Other versions with reduced number of components are not securely interlocked and may be defeated by simply pulling them apart.

Additionally, previous attempts at sealing the RF portion of the terminator, i.e., the portion of the terminator in electrical and mechanical contact with the female equipment port terminal, rely on a seal formed between the outer shell of the terminator and the device terminal, rather than forming a seal directly between the RF portion of the terminator and the female port. Moisture ingress between the outer shell and device terminal results in the possibility of corrosion not only in the RF interface but throughout the entire terminator. Corrosion in the RF interface may defeat the electrical termination by interfering with the proper electrical path. As mentioned above, corrosion in the remainder of the terminator may result in the fusing of the inner components and the outer shell, and thereby allow the terminator to be removed with commonly available hand tools.

It is common for coaxial terminators to be shipped from the manufacturer with the opposing ends of the terminator exposed. The equipment-side end of the terminator has an opening to extend over and engage the female equipment port, while the opposing end of the terminator includes an access hole through which the installation/removal tool is inserted. If left exposed during shipment, it is sometimes possible for the internal components of such terminators to become damaged during shipment. If such terminators are stored out in the field prior to use, or between uses, insects and other debris will often collect inside such open ends and interfere with later use of the terminator. Likewise, moisture can more easily enter inside such openings. Similarly, when such a terminator is installed over a female port terminal of the equipment box, the rear access opening often remains open, again allowing for collection of debris and the entry of moisture.

The assembly of known tamper resistant terminators is often complicated by a need to form the outer shield or shell around the internal components after the internal components are inserted therein in order to retain the internal components inside the shell following assembly. This extra manufacturing step contributes additional cost to the production of such terminators.

Accordingly, it is an object of the present invention to provide a tamper resistant coaxial terminator with a relatively small number of parts that are easy and inexpensive to produce and assemble.

Another object of the present invention is to provide such a tamper resistant coaxial terminator providing improved environmental sealing between the terminator and an equipment port terminal in a cable transmission system.

Still another object of the present invention is to provide such a tamper resistant coaxial terminator that is less subject to moisture-induced corrosion that compromises the functionality of such terminators.

A further object of the present invention is to provide a method for producing such a tamper resistant coaxial terminator in a manner that materially reduces the cost of producing a tamper-resistant termination.

A yet further object of the present invention is to provide an accessory for such terminators that protects the internal components of the terminator during shipment, while preventing dirt, debris and/or insects from collecting within the terminator during storage or actual use.

These and other objects of the present invention will become more apparent to those skilled in the art as the description of the present invention proceeds.

SUMMARY OF THE INVENTION

Briefly described, and in accordance with one preferred embodiment thereof, the present invention relates to a tamper resistant coaxial terminator for securing and terminating a coaxial equipment port of an equipment box. A plug member, preferably in the form of an electrically-conductive RF port, has a first end with a central bore formed therein; this central bore includes an internally threaded region to threadedly engage the outer conductor of the coaxial equipment port, as by rotation of the RF port relative to the coaxial equipment port. The RF port is, in turn, inserted within a first end of an inner body in a tight-fitting manner, wherein the inner body and the RF port are coupled to each other for rotating as a unit. The second opposing end of the inner body includes a surface for receiving a special tool used to rotate the inner body and the RF port. An outer shield includes a central bore defined by an inner annular wall. The outer shield surrounds the inner body and is rotatably secured thereover. The first end of the outer shield restricts access to the RF port, while the opposing second end of the outer shield includes a bore formed therein for allowing insertion of the tool used to rotate the inner body and RF port. Preferably, a resistor is housed within the RF port; one end of the resistor includes a central pin extending from the RF port for being inserted within the female center conductor of the coaxial equipment port. The second end of the resistor is electrically coupled to the RF port, as by a solder joint or the like.

At least a portion of the central bore of the outer shield, and at least a first generally-cylindrical outer surface of the inner body, have like diameters for allowing the outer shield to rotate about the inner body without excessive wobble. To reduce the likelihood of failure due to corrosion, the inner body may also include a second outer surface of generally cylindrical shape disposed proximate the second of the inner body, but having a smaller outer diameter; thus, the second generally-cylindrical surface is spaced radially inward from the internal annular wall of the outer shield. A sealing member, which may take the form of an O-ring, is positioned about the inner body along the second generally-cylindrical surface of reduced outer diameter. This sealing member engages not only the inner body but also the internal annular wall of the outer shield for preventing moisture from passing along the internal annular wall of the outer shield between the internal annular wall of the outer shield and the first generally-cylindrical outer surface of the inner body. Accordingly, the likelihood of corrosion building up between the internal annular wall of the outer shield and the first generally-cylindrical outer surface of the inner body is reduced. Preferably, an annular recess, of reduced diameter, is formed within the second outer generally-cylindrical surface of the inner body for seating the sealing member.

In order to form a more reliable seal between the RF port and the female equipment port, the end of the outer shield that surrounds the RF port preferably flares outwardly away from the RF port for creating an annular space between the first end of the RF port and the surrounding outer shield. A generally tubular seal is provided for extending around the externally-threaded outer conductor of the coaxial equipment port. A first end of the generally tubular seal is adapted to engage a surface of the equipment box, while the second end of the generally tubular seal extends over the RF port and within the annular space between the outer shield and the RF port. Thus, the tubular seal directly engages both the female equipment port and the RF port of the terminator. Preferably, the internal annular wall of the outer shield surrounding the RF port includes a beveled surface for compressing the second end of the generally tubular seal inwardly toward the RF port as the terminator is tightened over the coaxial equipment port.

As an alternative to the use of a sealing member engaged between the inner body and the outer shield, an alternate embodiment of the present invention forms the outer shield from a non-metallic material, e.g., a durable plastic material, that does not corrode in the presence of moisture. In this event, the internal diameter of the outer shield can be closely matched with the outer diameter of the inner body for supporting the inner body within the central bore of the outer shield while permitting relative rotation therebetween, even if the inner body is made from a metallic material subject to corrosion.

As mentioned above, the RF port is inserted into the first end of the inner body to secure such components together. As was also mentioned above, it is desirable to rotatably secure the inner body within the outer shield. In one preferred embodiment of the present invention, the first end of the inner body includes a deformable lip, and the internal annular wall of the outer shield has an annular recess formed therein. As the RF port is inserted into the first end of the inner body, as by a press-fit or the like, the deformable lip is extended into the annular recess to secure the inner body within the outer shield while permitting relative rotation therebetween. The RF port preferably includes an outwardly-beveled surface to deform the deformable lip outward as the RF port is press fit into the first end of the inner body.

In another preferred embodiment of the present invention, the first end of the inner body includes a central bore and an internally threaded region to threadedly engage the outer conductor of the coaxial equipment port. The second end of the inner body again includes a surface adapted to receive a special tool used to rotate the inner body. In this embodiment, the inner body includes a radially deformable region that is inset from the first end of the inner body; the radially deformable region has an outwardly projecting annular rib formed upon its outer surface. The terminator again includes an outer shield having a central bore defined by an internal annular wall. An annular recess is formed in the internal annular wall of the outer shield. During assembly, the outwardly projecting annular rib of the inner body is extended into the annular recess formed in the internal annular wall of the outer shield to rotatably secure the inner body within the outer shield.

In the case that the terminator does not require a resistor, the structure described in the preceding paragraph provides a simple, minimal-cost, tamper resistant terminator. After inserting the inner body within the outer shield, the deformable region can be deformed by inserting a deforming tool into the inner body to force the deformable region radially outward, after which the deforming tool can be removed. Preferably, the terminator also includes an RF port/resistor for terminating the equipment port with a proper characteristic impedance. In this event, the terminator further includes an electrically-conductive RF port member received within the first end of the inner body and which, after final assembly, is recessed from the first end of the inner body relative to the threaded region thereof; the RF port member does not require internal threads in this embodiment since the RF port member does not threadedly engage the equipment port. The RF port member is press-fit inside the inner body and performs the function of deforming the deformable region of the inner body, and radially expanding the circular rib, during such press-fit operation. The RF port member and the inner body are preferably firmly coupled to each other for rotating as a unit. The RF port member preferably has a central bore, and a resistor is preferably housed within the RF port member. Once again, the first end of the resistor includes a central pin extending from the RF port member for being inserted within the female center conductor of the coaxial equipment port, and the second end of the resistor is electrically coupled, as by a solder joint, to the RF port member.

As in the case of the previous embodiment, a sealing member, e.g., an O-ring, may be incorporated onto the second end of the inner body to block the passage of corrosion causing moisture beyond the sealing member toward the region where the outer diameter of the inner body is matched to the internal diameter of the inner annular wall of the outer shield. Alternatively, and as was true for the previous embodiment, the outer shield may be made from a non-metallic material, e.g., a durable plastic, that does not corrode in the presence of moisture. In this event, the internal diameter of the outer shield can be closely matched with the outer diameter of the inner body for supporting the inner body within the central bore of the outer shield while permitting relative rotation therebetween, even if the inner body is made from a metallic material subject to corrosion.

To provide a reliable environmental seal between the first end of the inner body and the female equipment port, the end of the outer shield that surrounds the first end of the inner body preferably flares outwardly away from the first end of the inner body for creating an annular space therebetween. A generally tubular seal is provided for extending around the externally-threaded outer conductor of the coaxial equipment port. A first end of the generally tubular seal is adapted to engage a surface of the equipment box, while the second end of the generally tubular seal extends over the first end of the inner body, and within the annular space between the outer shield and the first end of the inner body. Thus, the tubular seal directly engages both the female equipment port and the first end of the inner body of the terminator. Preferably, the internal annular wall of the outer shield surrounding the first end of the inner body includes a beveled surface for compressing the second end of the generally tubular seal inwardly toward the first end of the inner body as the terminator is tightened over the coaxial equipment port.

Another aspect of the present invention relates to the method of assembling such tamper resistant terminators. In one preferred embodiment of such method, the resistor is inserted into an RF port with a conductive pin extending therefrom. The opposing end of the resistor is electrically joined with the RF port, as by a solder joint or the like. If the terminator does not require a resistor, then steps may be omitted. The second end of the inner body is inserted into the central bore of the outer shield, and the RF port is then force-fit into the first end of the inner body to firmly attach the RF port thereto. The operation of inserting the RF port into the first end of the inner body simultaneously deforms an outwardly-deformable portion of the inner body, preferably a deformable lip, into engagement with an annular recess formed in the inner wall of the outer shield to retain the inner body within the outer shield while permitting relative rotation therebetween.

In a second embodiment of such a method of assembling a tamper resistant coaxial terminator, the resistor is inserted into an RF port member with a conductive pin extending therefrom. The opposing end of the resistor is electrically joined with the RF port member, as by a solder joint or the like. Once again, if the terminator does not require a terminator, then these steps may be omitted. The second end of the inner body is inserted into the central bore of the outer shield, and the RF port member is then force-fit into the first end of the inner body to firmly attach the RF port thereto. The operation of inserting the RF port member into the first end of the inner body simultaneously deforms an outwardly-deformable portion of the inner body, preferably including a circular rib formed thereupon. During such insertion of the RF port member into the inner body, the circular rib is advanced radially outwardly into engagement with an annular recess formed in the inner wall of the outer shield to retain the inner body within the outer shield while permitting relative rotation therebetween. Alternatively, when making a simple and inexpensive resistor-less, two-piece terminator, the RF port member may be omitted; the inner body is simply inserted into the outer shield, and a deforming tool may be inserted into the central bore of the inner body to deform the deformable region thereof, after which the deforming tool may be removed. The deforming tool may be inserted into the inner body either through the first end of the inner body, or through the second end of the inner body (via an outer shield access port used to install or remove the connector from an equipment port).

A further aspect of the present invention relates to a cap, preferably made from a resilient material, and adapted to selectively seal either a first end or a second end of a tamper resistant coaxial terminator of the type generally described above. The cap includes first and second opposing ends. The first end of the cap has a generally cylindrical first outer diameter commensurate with the internal diameter of the RF port of the terminator. In addition, the first end of the cap has an aperture formed therein for receiving the conductive center pin of the tamper resistant coaxial terminator as the first end of the cap is inserted into the first end of the tamper resistant coaxial terminator; this aperture is preferably bounded by a generally conical inner wall, the inner wall increasing in diameter as it approaches the first end of the cap. The second end of the cap has a generally cylindrical second outer diameter commensurate with the internal diameter of the second end of the terminator, i.e., the internal diameter of the outer shield aperture that provides access for the installation tool. The second end of the cap preferably includes a truncated conical surface formed by a tapered outer wall to assist in guiding the second end of the cap into the second end of the tamper resistant coaxial terminator, and to cause the second end of the cap to become compressed as it is inserted further into the second end of the tamper resistant coaxial terminator.

DETAILED DESCRIPTION OF THE PREFERRED EMBODIMENTS

Figure 1:
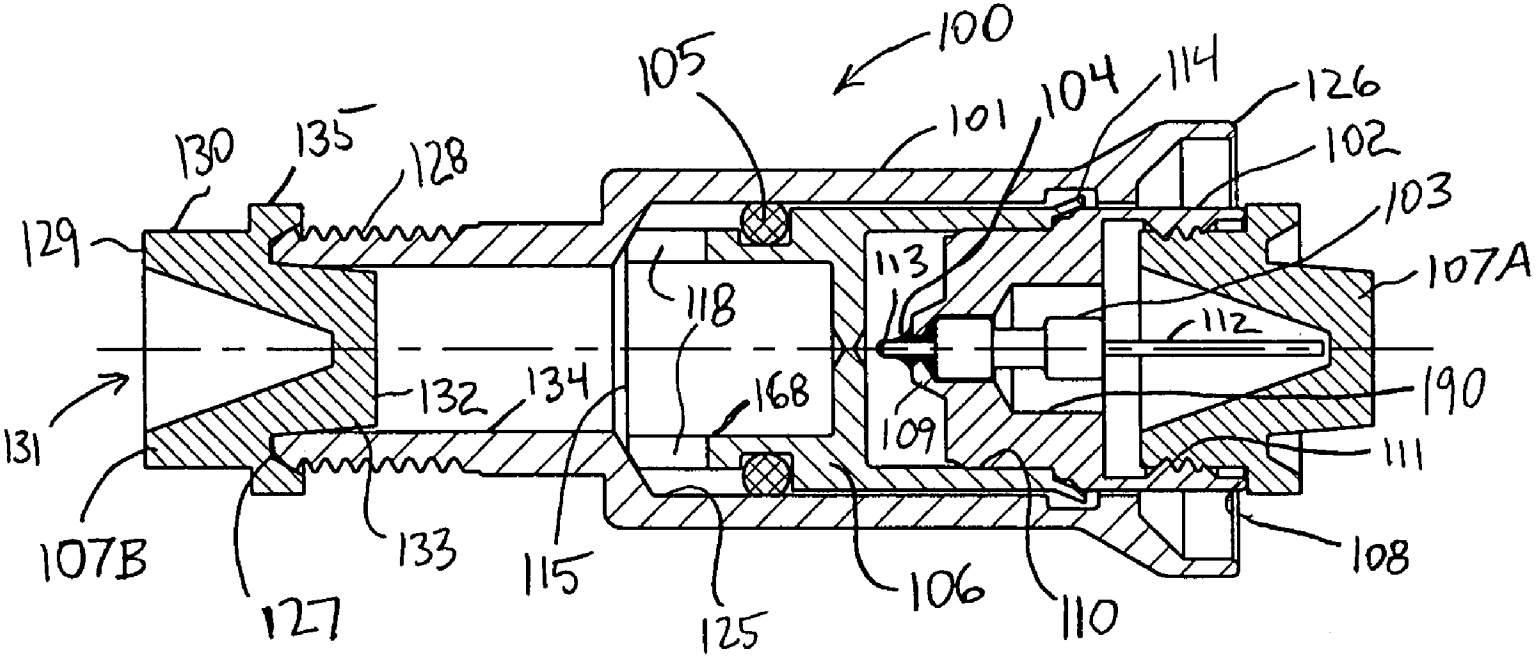
FIG. 1 is a cross-sectional view of a tamper resistant coaxial terminator, including a pair of end caps, according to a first preferred embodiment of the present invention.

FIG. 1 illustrates a tamper resistant coaxial terminator for securing and terminating a coaxial equipment port of an equipment box, and constructed in accordance with a first embodiment of the present invention, along with a pair of end caps. The tamper resistant coaxial terminator 100 comprises an outer shield 101, an internally-threaded RF port 102, resistor 103, o-ring 105, inner body 106, and first and second seal plugs, or end caps, 107A and 107B. RF port 102 is made of electrically-conductive material, such as tin-plated brass, and extends between first and second opposing ends 108 and 109, respectively. First end 108 of RF port 102 has an inner surface defining a central bore 190 including an internally threaded region 111 for mating with the threads formed upon the outer conductor of a typical coaxial female equipment port, via rotation of RF port 102 relative to such equipment port.

Resistor 103 is housed within the central bore 190 of RF port 102 and extends between first end 112 and second end 113. First end 112 includes a central conductive pin which extends proximate to, and just beyond, first end 108 of RF port 102 for being inserted within the female center conductor of the coaxial equipment port. Second end 113 of resistor 103 is electrically and mechanically coupled to RF port 102, as by solder joint 104. Some coaxial cable system operators have determined that it is not necessary to incorporate such a resistor, and prefer to omit the resistor in order to lower the cost, and hence the price, of such terminators. In such instances, resistor 103, and solder joint 104, can be omitted.

Figure 10:
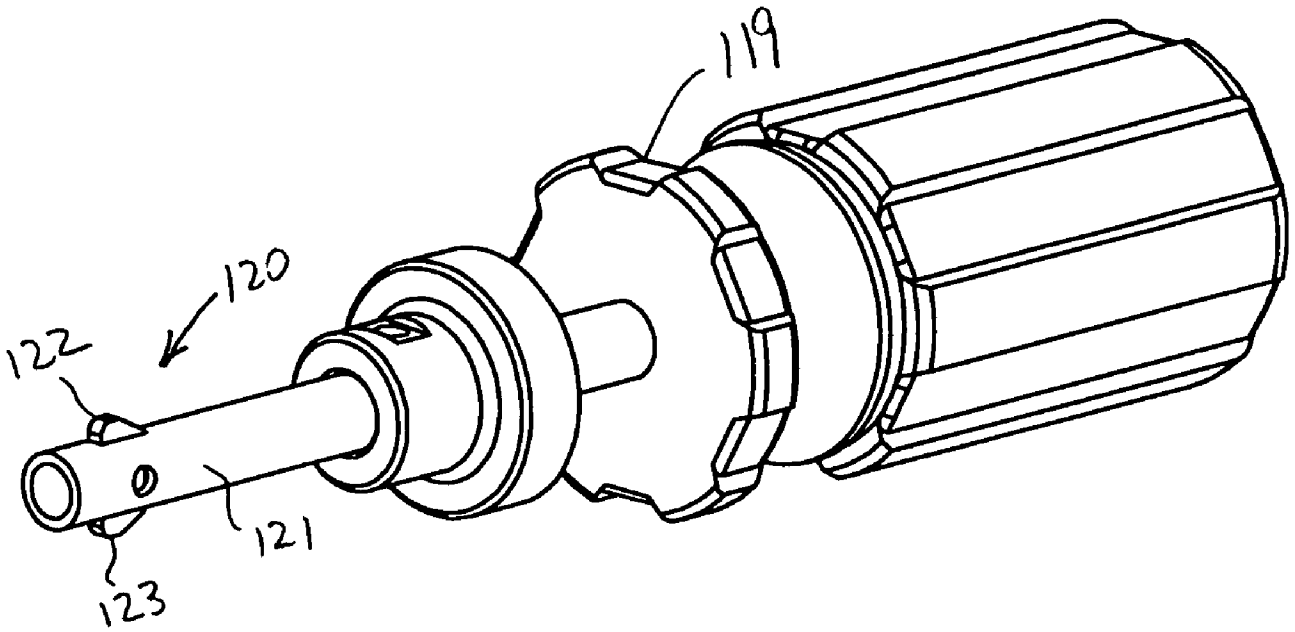
FIG. 10 is a perspective view of a special installation tool which may be used to install or remove the terminators shown in FIGS. 1–9.
Figure 11:
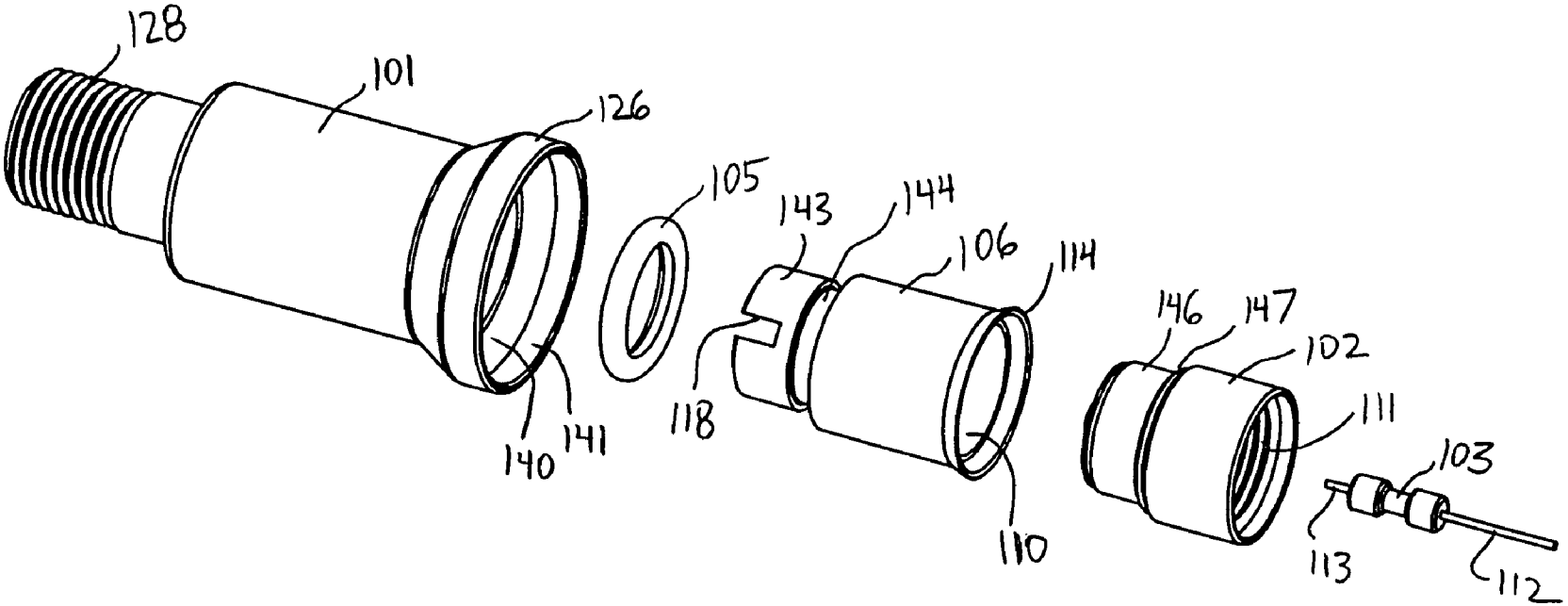
FIG. 11 is an exploded perspective view of the terminator shown in FIG. 4.

Inner body 106 extends between first end 114 and second end 115. First end 114 of inner body 106 has a central bore 110 formed therein for receiving second end 109 of RF port 102. RF port 102 is preferably press-fit into first end 114 of inner body 106 whereby inner body 106 and RF port 102 are securely coupled to each other for rotating as a unit. Second end 115 of inner body 106 has an inner surface defining a central cavity 168, and has slotted surfaces 118, for receiving a special tool used to rotate inner body 106. Referring briefly to FIG. 10, tool 119 includes a working end 120 that includes a cylindrical shaft 121 and a pair of spring-biased depressible wings 122 and 123. When working end 120 of tool 119 is inserted into terminator 100, and into cavity 168 of inner body 106, wings 122 and 123 engage slotted surfaces 118 to rotate inner body 106, along with RF port 102, to install or remove terminator 100 from a female equipment port.

Outer shield 101 includes a central bore defined by inner annular wall 125. Outer shield 101 surrounds inner body 106 and is rotatably secured over inner body 106 in a manner described in greater detail below. Outer shield 101 extends between a first end 126 and a second end 127. First end 126 extends around the first end 108 of RF port 102 for restricting access thereto. Second end 127 of outer shield 101 includes an inner surface defining a smaller diameter central bore 134, formed therein for allowing insertion of working end 120 of installation tool 119 (see FIG. 10) to rotate inner body 106. As further shown in FIG. 1, second end 127 of outer shield 101 preferably has external threads 128 formed thereon. Threads 128 provide a convenient way to attach a disconnected drop cable thereto, rather than allowing such unused drop cable to hang loose and unsupported.

Tamper-resistant terminator 100 is shown in FIG. 1 in a preferred "as shipped" position, and includes a pair of plugs or end caps 107A and 107B in place at the opposite ends of terminator 100. Preferably, plugs 107A and 107B are identical to each other, and are of such a design as to be utilized on either end of terminator 100, as illustrated. Plug 107A is removed from RF port 102 before securing terminator 100 over a female equipment port. Plug 107B may be left in place while terminator 100 is in use to protect against the entrance of dirt, debris or insects. Alternatively, plug 107B may be removed to allow threads 128 to be used as a parking port of an unused drop cable/connector assembly. Clearly, plug 107B is removed whenever it is necessary to insert working end 120 of tool 119 into terminator 100.

As shown in FIG. 1, each of caps 107A and 107B includes a first end 129 having a generally cylindrical outer surface 130 of a first outer diameter. This first outer diameter of outer surface 130 is generally commensurate with, or slightly larger than, the internal diameter of threaded region 111 of RF port 2. Caps 107A and 107B are preferably made of a resilient, elastic material that is compressible. Accordingly, first end 129 of cap 107B can be pushed inside first end 108 of RF port 102 (as is illustrated in FIG. 1 for cap 107A) and is retained therein by the threads or teeth forming threaded region 111 until forcibly removed by a technician. As shown in FIG. 1, cap 107B includes an aperture 131 that is preferably conically-shaped (the inner wall of aperture 131 increasing in diameter as it approaches first end 129), for receiving the conductive center pin 112 of a tamper resistant terminator as first end 129 of cap 107B is inserted therein.

Cap 107B also includes a second end 132 having a generally cylindrical, and preferably tapered, outer surface 133 having a second outer diameter that is generally commensurate with the internal diameter of bore 134 at second end 127 of outer shield 101. Second end 132 of cap 107B is adapted to be inserted within second end 127 of tamper resistant coaxial terminator 100. Outer surface 133 is preferably in the form of a truncated conical surface formed by a tapered outer wall to assist in guiding second end 132 of cap 107B into second end 127 of outer shield 101, and to cause second end 132 of cap 107B to become compressed as it is inserted further into bore 134 from the second end 127 of outer shield 101. As further illustrated, cap 107B may also include an enlarged outer flange 135 to prevent cap 107B from penetrating too far into either end of terminator 100.

Thus, caps 107A and 107B are preferably identical to each other and can be used interchangeably to protect either end of terminator 100.

Figure 2:
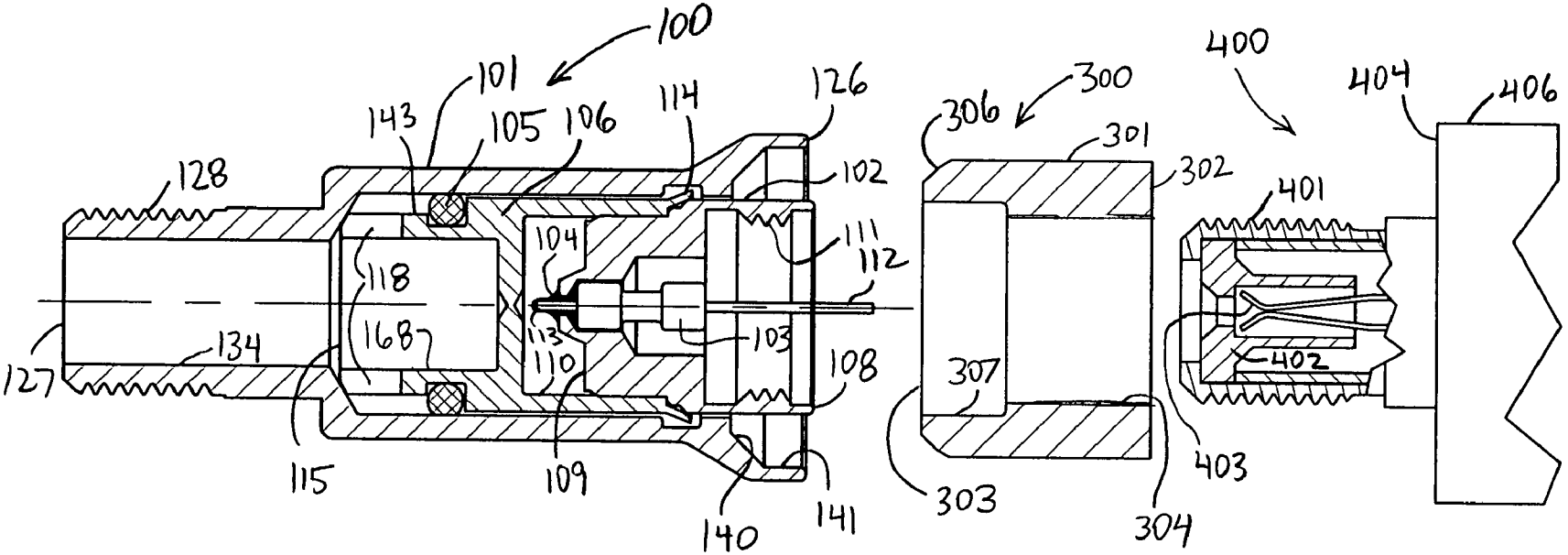
FIG. 2 is a cross-sectional, partially exploded, view of a tamper resistant coaxial terminator, a related tubular sealing ring, and a female coaxial equipment port.
Figure 3:
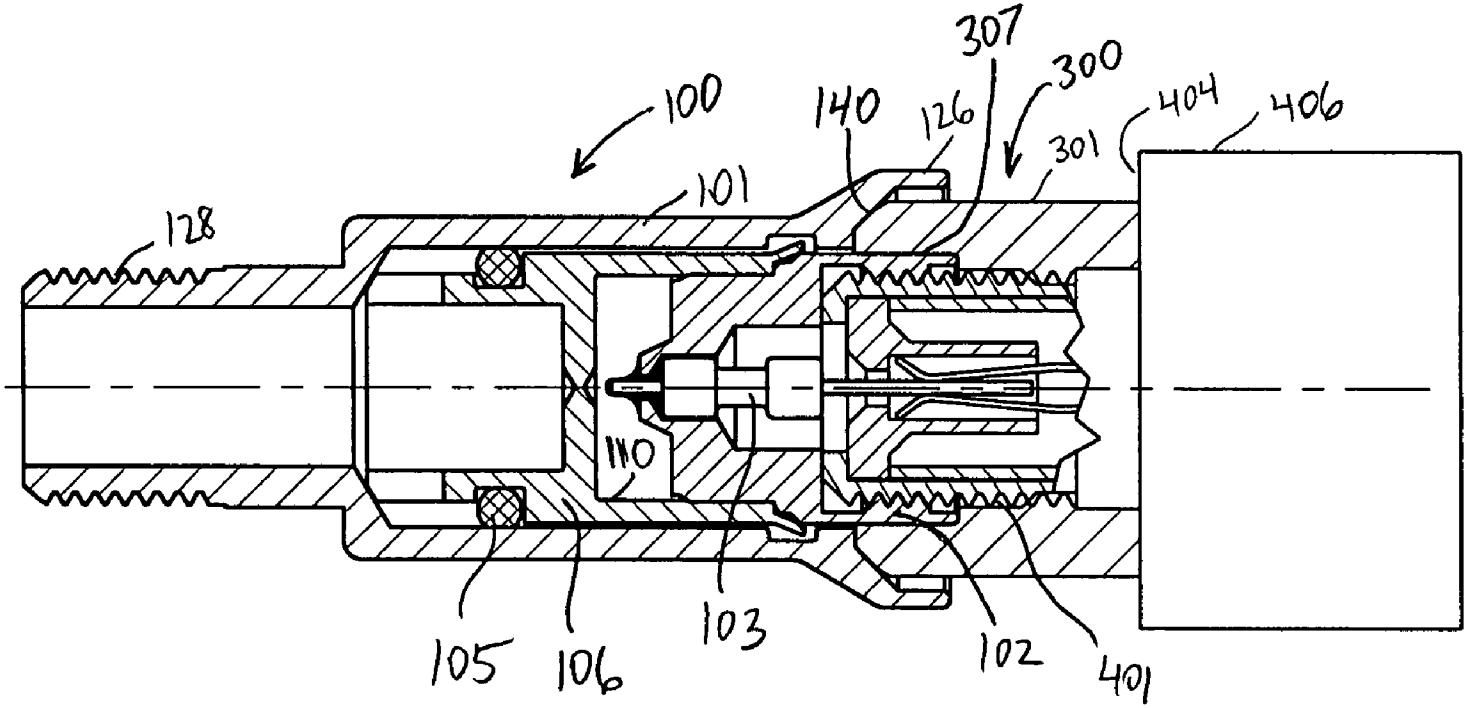
FIG. 3 is a cross-sectional view of the components shown in FIG. 2 after the terminator is secured over the female equipment port.

FIGS. 2 and 3 illustrate how terminator 100 of FIG. 1 can be environmentally sealed to a female equipment port 400 with the use of a tubular seal ring 300. Within FIG. 2, female equipment port 400 includes an equipment box 406, an externally-threaded outer conductor 401, a dielectric insulator 402, and a spring-biased center conductor contact 403 adapted to receive a center conductor of a coaxial connector.

Tubular seal ring 300 is preferably made from rubber or another suitable resilient, elastic material. Tubular seal ring 300 has an outer cylindrical surface 301 of a given outer diameter, and extends between first end 302 and second end 303. First end 302 of tubular seal ring 300 includes an inner surface defining a bore 304 having an internal diameter just less than that of the outer diameter of threaded outer conductor 401 of female equipment port 400. As is also shown in FIG. 2, second end 303 of tubular seal ring 300 preferably includes a beveled external portion 306 and an inner surface defining a bore 307; the internal diameter of bore 307 generally matches the outer diameter of RF port 102.

As shown in FIG. 2, the first end 126 of outer shield 101 is preferably flared outwardly; the inner wall of outer shield 101 at first end 126 preferably includes beveled region 140 and constant diameter region 141. The internal diameter of region 141 generally matches the outer diameter of surface 301 of tubular seal ring 300. An annular space is thereby created between first end 108 of RF port 102 and the surrounding first end 126 of outer shield 101; this annular space is adapted to receive second end 303 of the tubular seal ring 300.

In use, the first end 302 is extended over outer conductor 401 of equipment port 400. First end 302 of tubular seal ring 300 bears against, and engages, a base surface 404 of equipment box 406. The second end 303 of tubular seal ring 300 extends over first end 108 of RF port 102, and within the annular space between first end 126 of outer shield 101 and first end 108 of RF port 102. As RF port 102 is threadedly engaged with the outer conductor 401 of the equipment port, beveled surface 140 engages beveled surface 306 of tubular seal ring 300 and compresses second end 303 of tubular seal ring 300 inwardly toward first end 108 of RF port 102.

Those skilled in the art will note, with reference to FIG. 3, that a seal is formed directly between the outside diameter of threaded RF port 102 and the inside diameter 307 of seal ring 300. In contrast, prior attempts to form a seal at the equipment port have primarily formed a seal between the outer shield and the equipment port, as exemplified by the disclosure within U.S. Pat. No. 5,273,444 (Down, et al.). If desired, for example to lower the cost of producing the terminator, outer shield 101 may have its first end 126 formed in a more conventional fashion, without being flared, for allowing seal ring 300 to extend over first end 126, rather than under first end 126; such an embodiment is described below in conjunction with FIG. 13.

Figure 4:
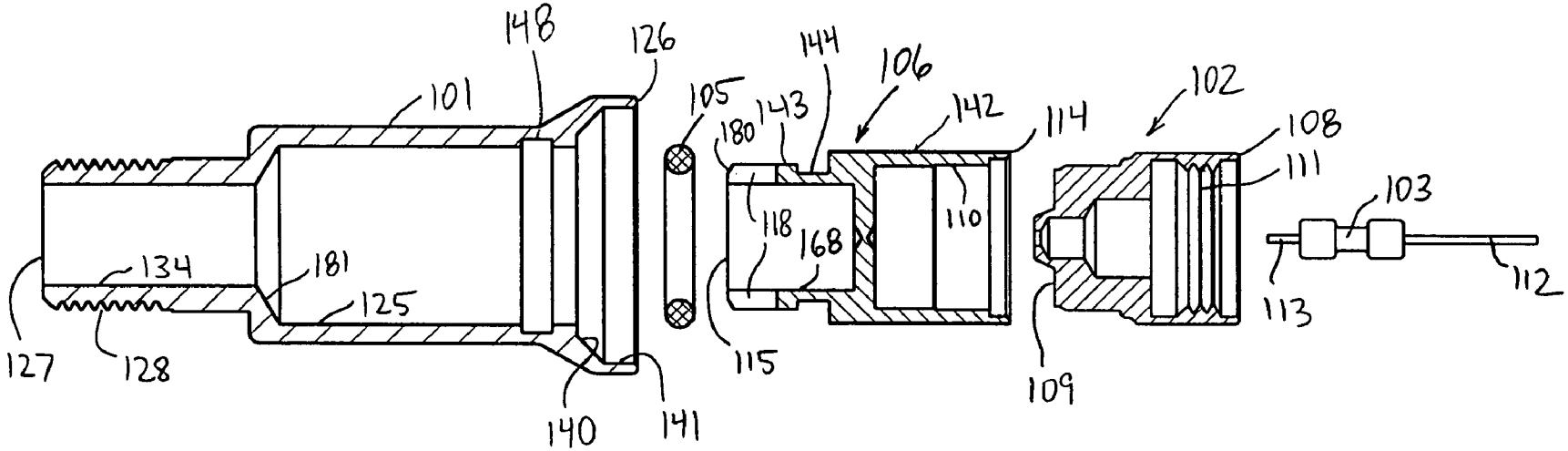
FIG. 4 is a cross-sectional exploded view of the components making up the terminator shown in FIGS. 1–3.

Referring now to the exploded view of FIG. 4, inner body 106 has a first outer generally-cylindrical surface 142 generally proximate to first end 114 thereof; surface 142 has an outer diameter commensurate with the internal diameter of central bore 125 of outer shield 101. In this manner, outer shield 101 is rotatably supported by outer surface 142 of inner body 106, at least so long as there is no significant corrosion buildup between such surfaces. Inner body 106 also includes a second outer generally-cylindrical surface 143 proximate second end 115 having an outer diameter that is smaller than that of first outer surface 142. Second outer surface 143 is spaced radially inward from the internal annular wall defining bore 125 of outer shield 101, as can be seen in FIG. 2.

O-ring 105 functions as a sealing member and is disposed about inner body 106 generally proximate to its second end 115. Preferably, inner body 106 includes an annular recess 144 formed in second outer surface 143, and O-ring 105 is retained within annular recess 144. O-ring 105 is engaged with both bore 125 of outer shield 101 and outer surface 143 of inner body 106 for preventing moisture from passing along the internal annular wall of outer shield 101 from second end 115 of inner body 106 toward first end 114 of inner body 106. The enlarged clearance area between reduced diameter surface 143 and outer shield bore 125 prevents corrosion bridging therebetween, so concern is reduced about the presence of moisture in this region of the terminator. It will be noted that the end 115 of inner body 106 preferably includes an angled, or beveled, surface 180; that outer shield 101 also preferably includes an angled, or beveled, surface 181; and that some physical contact does take place between angled surface 180 and angled surface 181. While such surfaces may be subject to moisture-induced corrosion, these angled surfaces mitigate any binding due to corrosion bridging between such angled surfaces.

Figure 5:
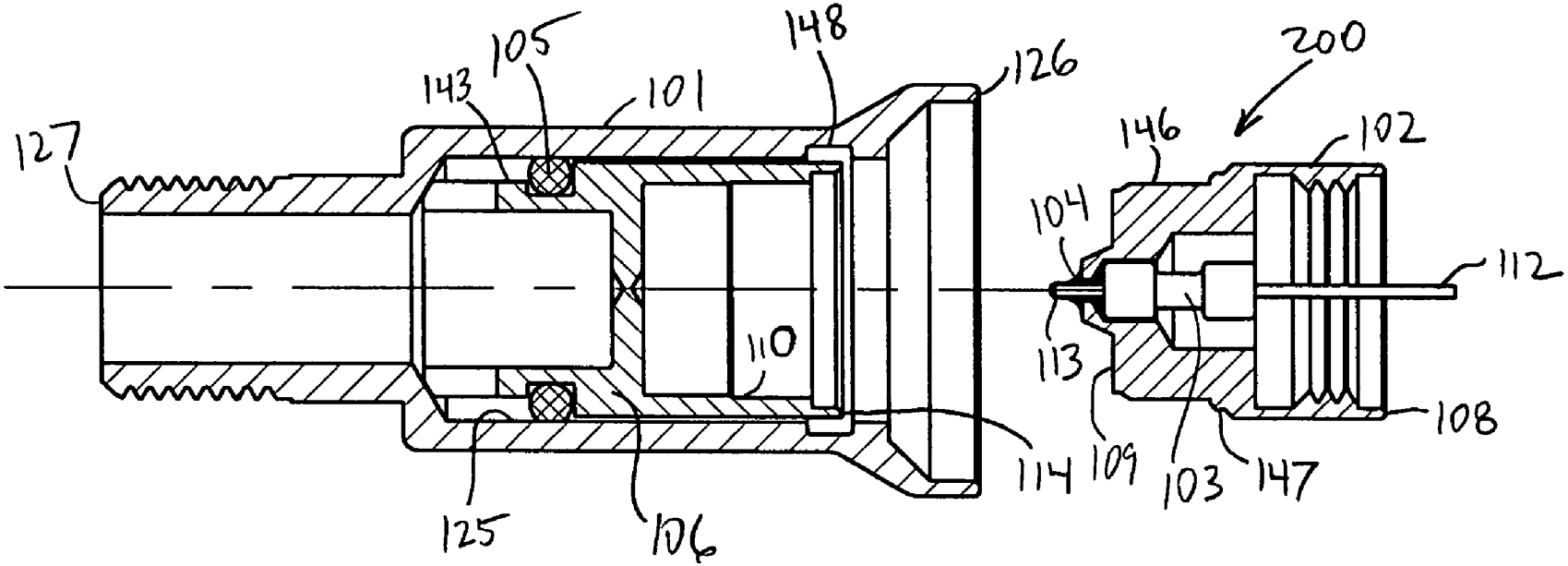
FIG. 5 is a cross-sectional view of the components shown in FIG. 4 at an intermediate stage in the assembly of the terminator.

Turning now to FIG. 5, terminator 100 is shown partially assembled. Resistor 103 is electrically and mechanically attached to threaded RF port 102 by solder joint 104. Once soldered, these components collectively form, a threaded RF port sub-assembly 200. O-ring 105 is installed into the annular recess (see 144 in FIG. 4) on outer surface 143 of inner body 106. Inner body 106, and O-ring 105 carried thereby, are then inserted into bore 125 of outer shield 101. At this stage of assembly, inner body 106 is not retained within outer shield 101, and could fall out if outer shield 101 were rotated or shaken.

Before leaving FIG. 5, it will be noted that first end 109 of RF port 102 has an outer cylindrical surface 146 of an outer diameter closely matched to the inner diameter of inner wall 110 of inner body 106. These matched surfaces preferably form a press-fit in the final assembly of the terminator. It will also be noted that the outer diameter of RF port 102 is stepped outwardly along stepped surface 147, or outwardly beveled, until reaching the maximum outer diameter of RF port 102 generally proximate to first end 108 of RF port 102.

Still referring to FIG. 5, first end 114 of inner body 106 has a wall of lesser thickness than the remainder of inner body 106. This thinned portion 114 of inner body 106 provides a deformable lip that can be deformed outwardly when biased by a force. Also, an annular recess 148 is formed within the inner annular wall defining central bore 125 of outer shield 101. As shown in FIG. 5, annular recess 148 is located at the same point along the longitudinal axis of the terminator at which deformable lip 114 is presented, generally proximate to the first end of the outer shield.

Figures 6, 6A:
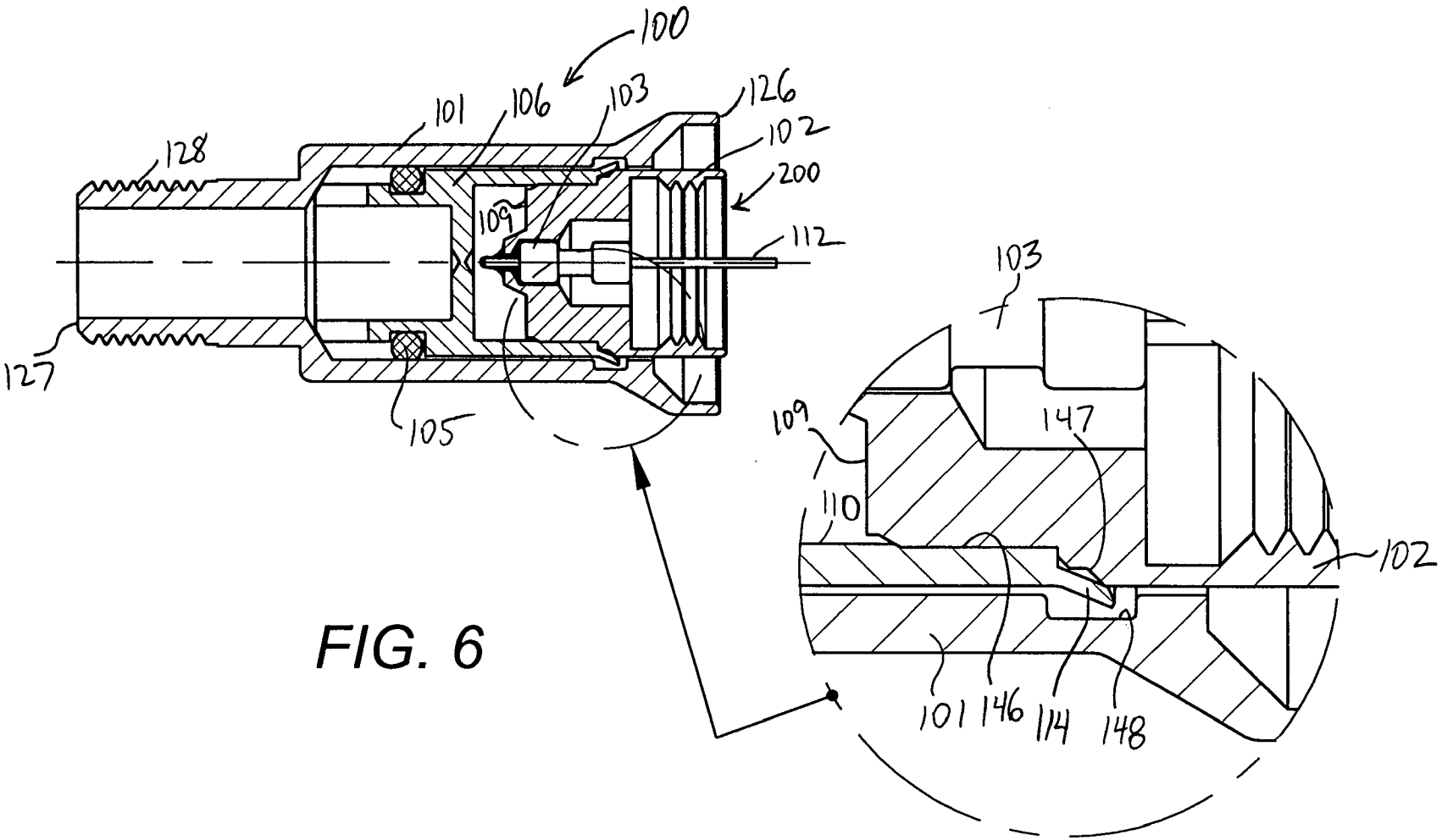
FIG. 6 is a cross-sectional view of the terminator following final production assembly.
FIG. 6A is a detailed close-up view of a flared deformed lip engaged with an annular recess formed in the inner wall of the outer shield.

Turning now to FIG. 6, the final assembly of the terminator includes the step of forcing second end 109 of RF port 102 into the first end 114 of inner body 106. As explained above, this forms a force-fit between such components that locks such components together to rotate as a unit. As shown best in the detailed FIG. 6A, the final seating of RF port sub-assembly 200 into inner body 106 causes stepped region 147 along the outer periphery of RF port 102 to engage deformable lip 114 and to force it to become circumferentially flared radially outward into annular recess 148. Now, deformable lip 114 ensures that inner body 106, and RF port 102, can not escape from within outer shield 101. However, deformable lip and annular recess 144 nonetheless permit outer shield 101 to freely rotate relative to inner body 106 and RF port 102. Another way of expressing this relationship is that internal parts 106 and 102 are rotatably captured within outer shield 101. Use of this method of assembling terminator 100 provides several advantages, including reduced number of components, simplified assembly, and reduced assembly time.

Figure 7:
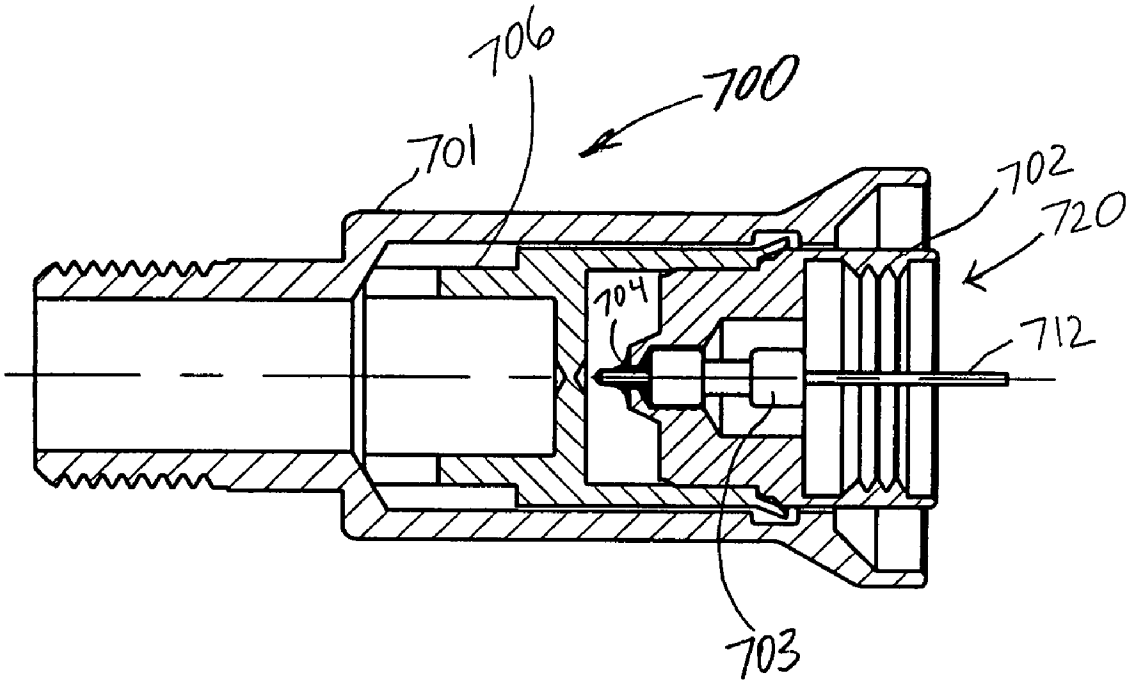
FIG. 7 is a cross-sectional view of an alternate embodiment similar to that shown in FIGS. 1–6 but wherein the structure of the inner body has been modified, and wherein the outer shield is made from a non-corrosive material.

FIG. 7 illustrates another embodiment of the tamper resistant coaxial terminator of the present invention, designated generally by reference numeral 700. Outer shield 701 is made of a material that is not subject to corrosion, such as a durable plastic material. The threaded RF port sub-assembly 720 is made in the same manner as was described for RF port sub-assembly 200 above relative to FIGS. 1–6, and includes threaded RF port 702, resistor 703, solder joint 704, and conductive pin 712. Inner body 706 is made from a conductive material, such as nickel-plated brass. Inner body 706 is made in generally the same manner as was described for inner body 106 relative to FIGS. 1–6, but omits any annular recess (see 144 in FIG. 4); accordingly, inner body 706 is more easily machined. By making outer shield 701 of plastic or another suitable non-corrosive material, binding between outer shield 701 and inner body 706 due to corrosion is prevented, eliminating the need for an internal seal such as an o-ring see 105 in FIGS. 1–6), and further reducing the cost of manufacturing terminator 700. Even though inner body 706 is made of a metallic material that may, in time, corrode, and although inner body 706 includes an outer diameter commensurate with the internal diameter of outer shield 701, binding due to corrosion will not occur, and free relative rotation is maintained between outer shield 701 and inner body 706. Insertion of inner body 706 within outer shield 701, and assembly of RF port 702 within inner body 706, is otherwise made in the same manner as was described above for the embodiment described in FIGS. 1–6. The assembled terminator 700 may be shipped and used in the same manner as was described above.

Figure 8:
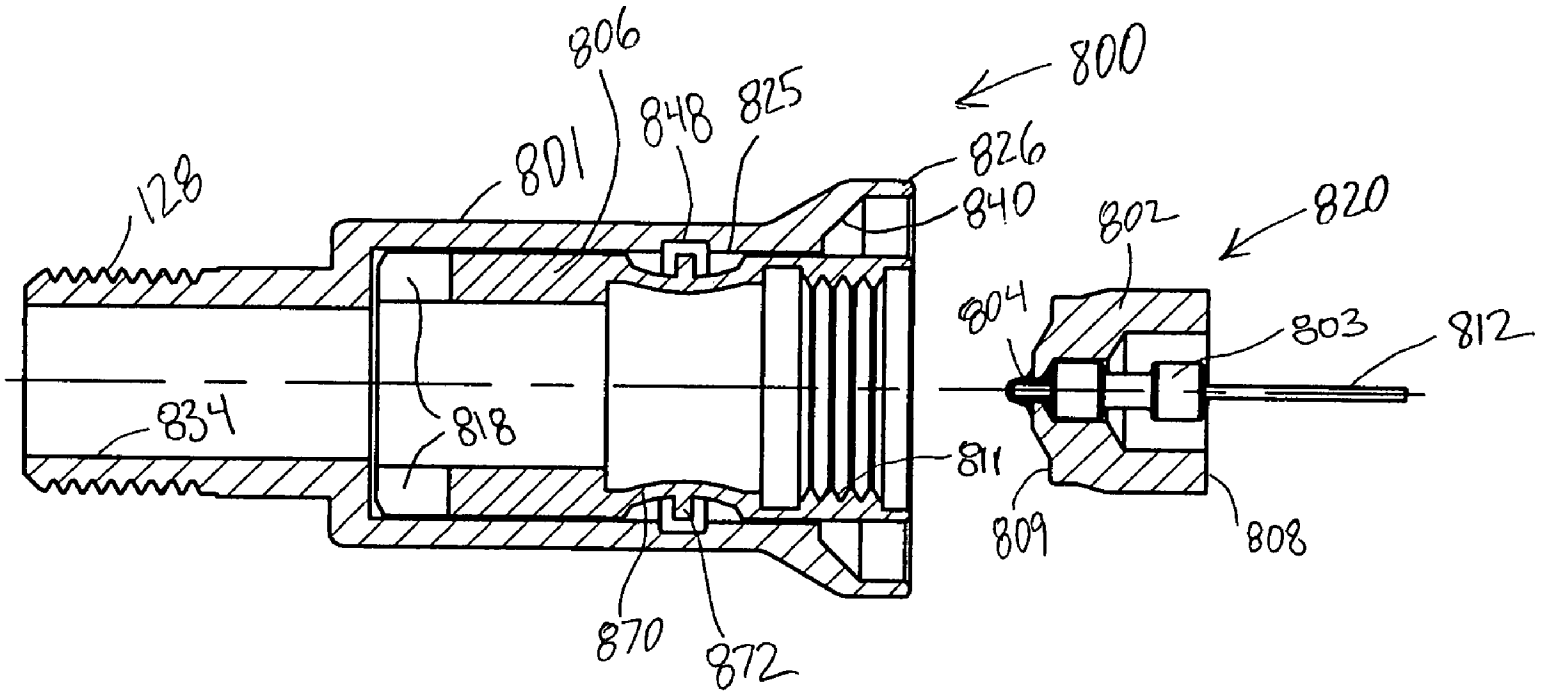
FIG. 8 is a cross-sectional, partially-exploded, view of another preferred embodiment of the present invention prior to completion of assembly, wherein the inner body directly engages the female equipment port, and wherein the inner body includes a deformable region including a radially projecting circular rib.
Figure 9:
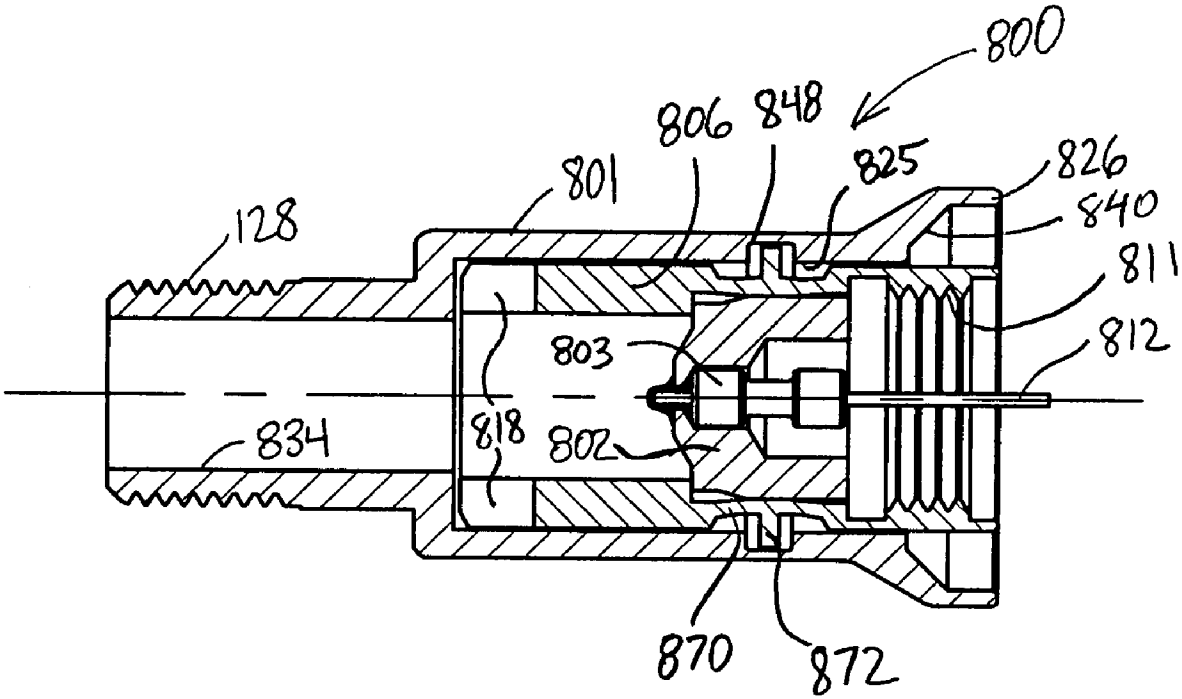
FIG. 9 is a cross-sectional view of the terminator of FIG. 8 after production assembly is completed, and showing the circular rib of the inner body engaged within an annular recess of the outer shield.

FIGS. 8 and 9 illustrate another preferred embodiment of a tamper resistant coaxial terminator constructed in accordance with the teachings of the present invention. As shown in FIG. 8, terminator 800 includes an RF port sub-assembly 820 that includes an RF port member 802 housing a resistor 803. Resistor 803 includes a first end in the form of conductive center pin 812 for engaging the female socket of an equipment port terminal. Resistor 803 includes a second opposing end electrically and mechanically joined with RF port member 802 by solder joint 804. As in the case of the embodiments described above, resistor 803, and solder joint 804, may be omitted, if desired, in those instances wherein a terminating resistor is not required. Indeed, as will be explained below in regard to FIG. 12, RF port member 802 may itself be omitted in some instances.

RF port member 802 is made of conductive material such as tin-plated brass. RF port member 802 differs from threaded RF port 102 of FIGS. 1–6 because it does not include internal threads for directly engaging the externally-threaded outer conductor of the female equipment port. RF port member 802 also differs from threaded RF port 102 in that its circumferential contour increases more gradually along a beveled surface from its rear end 809 toward its front end 808, rather than in a stepped fashion.

Still referring to FIGS. 8 and 9, outer shield 801 is made from a durable plastic or other non-corrosive material in this preferred embodiment. Outer shield 801 includes an enlarged diameter forward lip 826 leading to a tapered inner wall 840 for receiving and compressing a tubular seal ring (see 300 in FIGS. 2 and 3); in the present embodiment, such a tubular seal ring would be compressed against the first end of inner body 806, rather than against a threaded RF port. Outer shield 801 includes a threaded rear periphery to park an unused F-connector. Outer shield 801 also includes a rear bore 834 for allowing access by the installation tool shown in FIG. 10. Outer shield 801 includes a larger central bore 825 for receiving inner body 806. The enlarged forward lip 826 of outer shield 801 is disposed around the first, threaded end of inner body 806 for restricting access thereto. As in the prior embodiments, the rear portion of inner body 806 includes slotted surfaces 818 for being rotated by installation tool 119 of FIG. 10. The front end of inner body 806 extends approximately flush with the enlarged lip 826 of outer shield 801. Moreover, the front end of inner body 806 is internally threaded, as designated by reference numeral 811, for engaging the outer conductor of the female equipment port.

As in the case of the embodiment illustrated in FIGS. 1–6, it is again desired to internally capture inner body 806, and RF port 820, within outer shield 801 upon completion of assembly, while permitting free rotation as between outer shield 801 and inner body 806. For such purpose, the central bore 825 of outer shield 801 includes an annular recess 848 providing a groove or relief. Likewise, inner body 806 includes a radially deformable region, this time in the form of a bowed, thinned region 870 which has an outwardly-extending external circular rib 872 formed thereupon. The inner diameter of inner body 806 in this bowed region 870 is initially less than the enlarged outer diameter of RF port member 802. Initially, rib 872 has an outer diameter that is slightly less than the internal diameter of central bore 825 to avoid any interference therebetween as inner body 806 is inserted into outer shield 801.

During final assembly, as shown in FIG. 9, threaded RF port sub-assembly 820 is press-fit into the front end of inner body 806 whereby inner body 806 and RF port sub-assembly 820 are fixedly coupled to each other for rotating as a unit. When pressed into inner body 806, bowed region 870, and circular rib 872, are circumferentially moved outward by the beveled surface formed upon the periphery of RF port 802. External rib 872 is thereby caused to expand into groove 848 of outer shield 801. Once threaded RF port sub assembly 820 is press-fit with inner body 806, inner body 806 and press-fit RF port sub-assembly 820 are rotatably captured within outer shield 801.

As illustrated in FIGS. 8 and 9, outer shield 801 is made from a plastic or other non-corrosive material. Alternatively, outer shield 801 may be made from metal, in which case the rear end of inner body 806 preferably has the form shown in FIG. 4 for carrying an internal seal, e.g., an o-ring like that shown in FIGS. 1–6.

Figure 12:
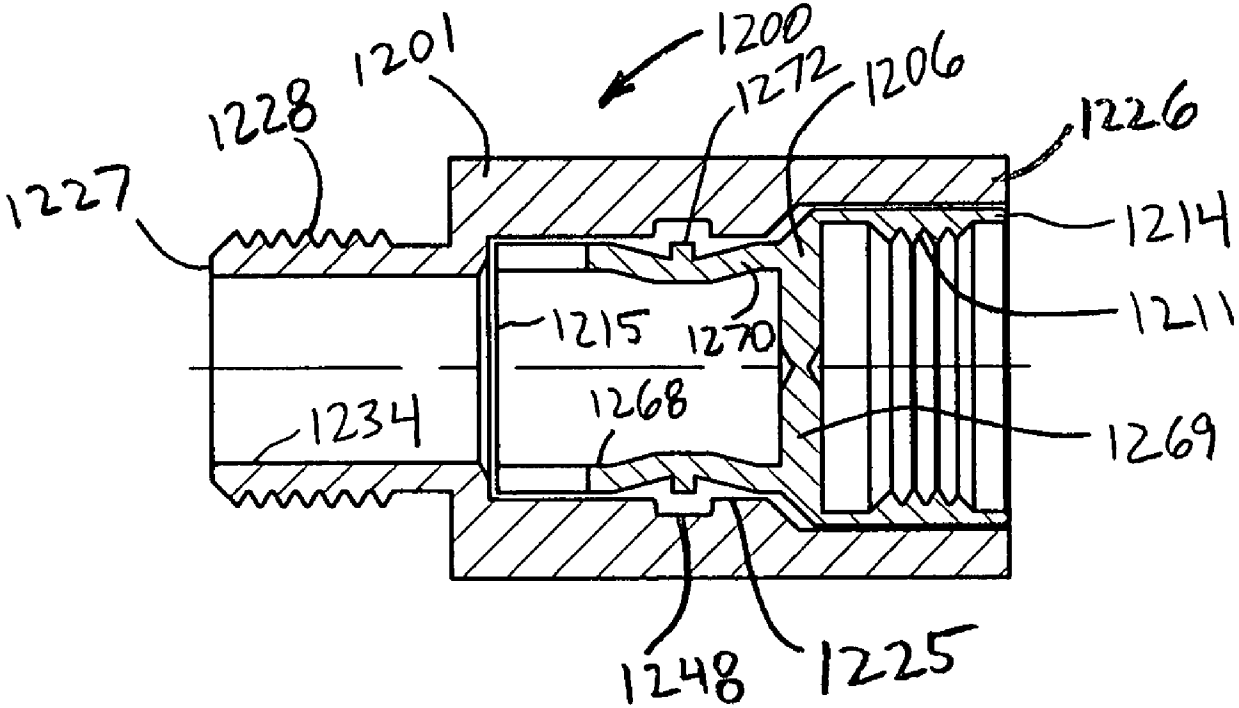
FIG. 12 is a cross-sectional view of a simplified two-piece, resistor-less terminator just prior to final assembly, and using a simplified shape for the outer shield.

Referring now to FIG. 12, an alternate embodiment of the present invention is illustrated which provides a particularly simple, two-piece tamper resistant terminator that can be manufactured very easily and inexpensively. Terminator 1200 includes an outer shield 1201 and an inner body 1206. Outer shield 1201 has a first end and a second opposing end 1227. The second end 1227 preferably includes external threaded region 1228 for parking an unused coaxial cable.

Outer shield 1201 includes an inner annular wall defining a central inner bore 1225 accessible from first end 1226 for receiving inner body 1206; central bore 1225 includes an enlarged annular recess 1248 formed therein to aid in rotatably captivating inner body 1206 within outer shield 1201. The second end of outer shield 1201 also includes an inner annular wall defining a rear bore 1234 for allowing access by the installation tool shown in FIG. 10. To minimize cost, outer shield 1201 is preferably made of a non-corrosive material, for example, a durable plastic. First end 1226 of outer shield 1201 is shown as having a smooth, continuous outer cylindrical surface to simplify manufacture. If desired, the outer surface of first end 1226 of outer shield 1201 could be modified to include a thinned annular recess (see FIGS. 13 and 13A) to facilitate the receipt of a tubular seal ring to help environmentally seal the joint between terminator 1200 and an equipment port.

Inner body 1206 includes a first end 1214 that has a threaded internal bore 1211 formed therein for engaging the threaded outer conductor of an equipment port (see 401 in FIG. 2). Terminator 1200 omits any RF port member or termination resistor. Inner body 1206 includes an opposing second end 1215 that includes a second end bore 1268. Internal bore 1211 and second end bore 1268 are divided from each other by a radial dividing wall 1269. Inner body 1206 includes a radially deformable region in the form of a bowed, thinned region 1270 which has an outwardly-extending external circular rib 1272 formed thereupon. The inner diameter of second end bore 1268 in this bowed region 1270 is initially less than the inner diameter elsewhere along second end bore 1268, and also less than the internal diameter of access bore 1234 formed in the second end 1227 of outer shield 1201. Initially, rib 1272 has an outer diameter that is slightly less than the internal diameter of central bore 1225 to avoid any interference therebetween as inner body 1206 is inserted into outer shield 1201.

During final assembly, bowed region 1270, and circular rib 1272, of inner body 1206 are moved radially outward, causing circular rib 872 to expand into annular recess 1248 of outer shield 1201. In this manner, inner body 1206 is rotatably captured within outer shield 1201. This deformation process may be performed by a deforming tool somewhat similar in appearance to the installation tool shown in FIG. 10, except that wings 122 and 123 can be eliminated, and the end of the tool is closed and slightly rounded. The end of the tool is then inserted through access bore 1234 and into second end bore 1268 of inner body 1206. The end of the tool is rounded to facilitate the outward expansion of bowed region 1270 as the rounded end of the tool increases the internal diameter of bowed region 1270. The end of the tool is thereafter removed.

Figures 13, 13A:
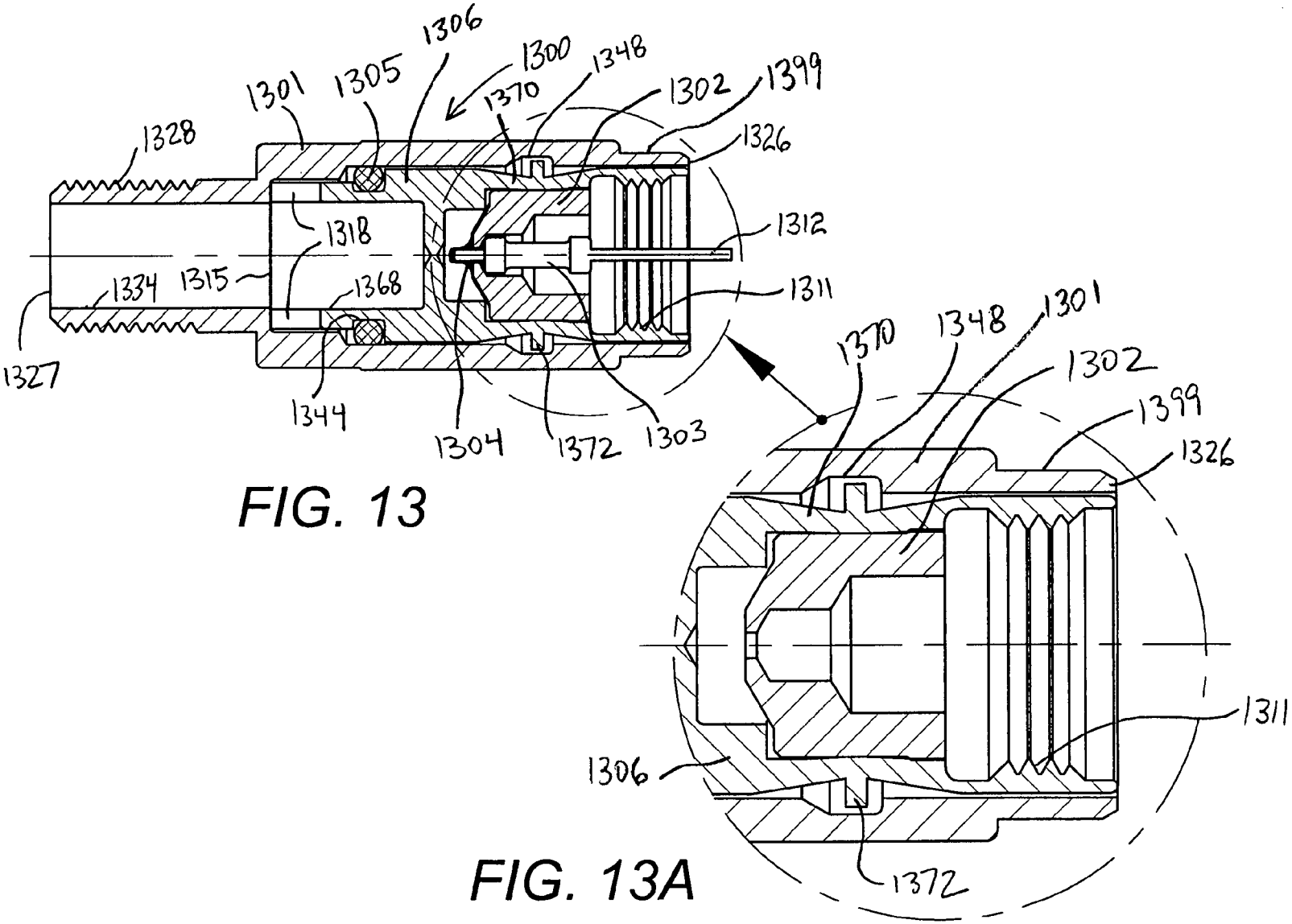
FIG. 13 is a cross-sectional view of an alternate embodiment of the terminator after final assembly, and using a simplified shape for the outer shield.
FIG. 13A is an enlarged, detailed cross-sectional view of a portion of the terminator shown in FIG. 13, but omitting a resistor or related solder joint.

FIG. 13 illustrates an alternate embodiment of the present invention that incorporates features of terminator 100 (see FIGS. 1–6) and terminator 800 (see FIGS. 8 and 9). Those features that are similar to those already described above in are labeled with 1300-series reference numerals corresponding to the 100-series and 800-series reference numerals used in the drawing figures already described above. Terminator 1300 uses an inner body 1306 having a deformable region 1370 that is deformed by RF port member 1302 in a manner similar to that already described in conjunction with FIGS. 8 and 9 above. The second end of inner body 1306 is sealed to the inner annular wall of outer shield 1301 by o-ring 1305 in the general manner described above in conjunction with FIGS. 1–6. First end 1326 of outer shield 1301 differs from the outer shields 101 and 801 described above by eliminating the flared lip formed in outer shields 101 and 801. Instead, first end 1326 of outer shield 1301 includes an outer surface 1399 of reduced diameter for extending inside a tubular seal ring (see 300 in FIG. 2). While this embodiment lacks the advantages of forming a seal directly between the seal ring and the threaded first end of inner body 1306, it is cheaper to machine outer shield 1301 if such flared lip is omitted.

FIG. 13A serves both to highlight the manner in which inner body 1306 is rotatably captivated within outer shield 1306, and also to illustrate a resistor-less variation of the terminator shown in FIG. 13. As shown in FIG. 13A, resistor 1303 and solder joint 1304 of FIG. 13 are omitted. RF port member 1302, or a simple plug having the same shape, is still press-fit into the first end of inner body 1306 to deform circular rib 1372 radially outward into annular recess 1348 during final assembly, resulting in a relatively simple and inexpensive resistor-less tamper-resistant terminator that can be used in conjunction with conventional tubular seal rings.

Those skilled in the art will now appreciate that an improved tamper resistant terminator, and method of manufacturing the same, have been described wherein the number of components has been reduced, wherein the cost of manufacture has been lowered, and wherein the simplified internal configuration decreases assembly time, and allows for optional automated assembly. It will further be appreciated that the terminator of the present invention forms a threaded interface with a female equipment port wherein the threaded interface is directly sealed to the mating equipment port by a seal ring, rather than relying upon a seal formed with the outer shield surrounding the threaded interface. Moreover, the alternative use of an outer shield made from a non-metallic and/or non-corrosive material allows for further simplification of the internal structure, even lower cost of production, and more reliable operation by eliminating corrosion formation that might otherwise cause the components to bind together. It will be further appreciated that the shipping cap described in conjunction with FIG. 1 of the drawings is useful in protecting such terminators during shipment while keeping insects and other debris from collecting within such terminators during storage or in actual use. While the present invention has been described with respect to preferred embodiments thereof, such description is for illustrative purposes only, and is not to be construed as limiting the scope of the invention. Various modifications and changes may be made to the described embodiments by those skilled in the art without departing from the true spirit and scope of the invention as defined by the appended claims.

We claim:

1. A tamper resistant coaxial terminator for securing and terminating a coaxial equipment port of an equipment box, the coaxial equipment port being of the type having a female center conductor adapted to receive a center conductor of a coaxial connector, the coaxial equipment port also being of the type including an externally threaded outer conductor surrounding the female center conductor and spaced apart therefrom by a dielectric, the tamper resistant coaxial terminator comprising in combination:

a. an electrically-conductive RF port having first and second opposing ends, the first end of the RF port having a central bore, and the first end of the RF port including an internally threaded region to threadedly engage the outer conductor of the coaxial equipment port through rotation of the RF port relative to the coaxial equipment port;

b. an inner body having first and second ends, a first end of the inner body having a central bore for receiving the second end of the RF port, the inner body and the RF port being coupled to each other for rotating as a unit, the second end of the inner body including a surface for receiving a tool used to rotate the inner body; and c. an outer shield having a central bore and surrounding the inner body and rotatably secured thereover, the outer shield having a first end disposed around the RF port for restricting access thereto, the outer shield including a second opposing end having a bore formed therein for allowing insertion of said tool to rotate the inner body.

2. The tamper resistant coaxial terminator recited by claim 1 further including a resistor housed within the RF port and having first and second ends, the first end of the resistor including a central pin extending within the central bore of the RF port proximate the first end of the RF port for being inserted within the female center conductor of the coaxial equipment port, the second end of the resistor being electrically coupled to the RF port.

3. The tamper resistant coaxial terminator recited by claim 1 wherein:

a. the central bore of the outer shield is defined by an internal annular wall, at least a portion of the internal annular wall of the outer shield having a predetermined internal diameter, and the outer shield being made of a non-metallic material that does not corrode in the presence of moisture, and b. the inner body is made of a metallic material and includes a first outer generally-cylindrical surface having an outer diameter commensurate with said predetermined internal diameter for supporting the inner body within the central bore of the outer shield while permitting relative rotation therebetween.

4. The tamper resistant coaxial terminator recited by claim 1 wherein:

a. the central bore of the outer shield is defined by an internal annular wall, at least a portion of the internal annular wall of the outer shield having a predetermined internal diameter, b. the inner body having a first outer generally-cylindrical surface proximate the first end thereof having an outer diameter commensurate with said predetermined internal diameter for supporting the inner body within the central bore of the outer shield while permitting relative rotation therebetween, the inner body including a second outer generally-cylindrical surface proximate the second end thereof having an outer diameter smaller than that of the first outer generally-cylindrical surface, the second generally-cylindrical surface being spaced radially inward from the internal annular wall; and c. a sealing member disposed about the inner body generally proximate the second end thereof and engaged with the internal annular wall of the outer shield for preventing moisture from passing along the internal annular wall of the outer shield from the second end of the inner body toward the first end of the inner body.

5. The tamper resistant coaxial terminator recited by claim 4 wherein an annular recess is formed within the second outer generally-cylindrical surface of the inner body, and wherein the sealing member is retained within the annular recess.

6. The tamper resistant coaxial terminator recited by claim 1 wherein the first end of the outer shield has an enlarged internal diameter for creating an annular space between the first end of the RF port and the surrounding first end of the outer shield, the tamper resistant coaxial terminator further including a generally tubular seal for extending around the externally-threaded outer conductor of the coaxial equipment port, the generally tubular seal extending between first and second opposing ends, the first end of the generally tubular seal being adapted to engage a surface of the equipment box, and a second end of the generally tubular seal extending within the annular space between the first end of the outer shield in the first end of the RF port.

7. The tamper resistant coaxial terminator recited by claim 6 wherein the enlarged internal diameter provided at the first end of the outer shield includes a beveled surface for compressing a second end of the generally tubular seal inwardly toward the first end of the RF port as the terminator is tightened over the coaxial equipment port.

8. The tamper resistant coaxial terminator recited by claim 1 wherein:

a. the first end of the inner body includes a deformable lip;

b. the central bore of the outer shield is defined by an internal annular wall, the internal annular wall having an annular recess formed therein generally proximate to the first end of the outer shield; and c. the deformable lip extends into the annular recess to secure the inner body within the outer shield while permitting relative rotation therebetween.

9. The tamper resistant coaxial terminator recited by claim 8 wherein the second end of the RF port is secured to the first end of the inner body by a press fit.

10. The tamper resistant coaxial terminator recited by claim 9 wherein the RF port includes an outwardly-beveled surface to deform the deformable lip outward as the RF port is press fit into the first end of the inner body.

11. A tamper resistant coaxial terminator for securing and terminating a coaxial equipment port of an equipment box, the coaxial equipment port being of the type having a female center conductor adapted to receive a center conductor of a coaxial connector, the coaxial equipment port also being of the type including an externally-threaded outer conductor surrounding the female center conductor and spaced apart therefrom by a dielectric, the tamper resistant coaxial terminator comprising in combination:

a. an inner body having first and second ends, the first end of the inner body having a central bore including an internally threaded region to threadedly engage the outer conductor of the coaxial equipment port through rotation of the inner body relative to coaxial equipment port, the second end of the inner body including a surface for receiving a tool used to rotate the inner body, the inner body including a radially deformable region having an outwardly projecting annular rib;

b. an outer shield having a central bore defined by any internal annular wall, the internal annular wall having an annular recess formed therein generally proximate to the first end of the outer shield and surrounding the inner body, the outer shield having a first end disposed around the first end of the inner body for restricting access thereto, the outer shield including a second opposing end having a bore formed therein for allowing insertion of said tool to rotate the inner body; and c. wherein the outwardly projecting annular rib of the inner body extends into the annular recess formed in the internal annular wall of the outer shield to rotatably secure the inner body within the outer shield.

12. The tamper resistant coaxial terminator recited by claim 11 wherein the second end of the inner body has an inner wall defining a second end bore extending into the second end of the inner body from the second end thereof, the second end bore of the inner body extending at least to the radially deformable region of the inner body, the second end bore of the inner body communicating with the bore formed in the second end of the outer shield, whereby a deforming tool can be inserted through the second end of the outer shield, and into the second end bore of the internal body to radially deform the deformable region of the inner body outwardly.

13. The tamper resistant coaxial terminator recited by claim 11 wherein:

a at least a portion of the internal annular wall of the outer shield has a predetermined internal diameter, and the outer shield being made of a non-metallic material that does not corrode in the presence of moisture; and b. the inner body is made of a metallic material and includes a first outer generally-cylindrical surface having an outer diameter commensurate with said predetermined internal diameter for supporting the inner body within the central bore of the outer shield while permitting relative rotation therebetween.

14. The tamper resistant coaxial terminator recited by claim 11 wherein:

a. at least a portion of the internal annular inner wall of the outer shield has a predetermined internal diameter;

b. the inner body has a first outer generally-cylindrical surface proximate the first end thereof having an outer diameter commensurate with said predetermined internal diameter for supporting the inner body within the central bore of the outer shield while permitting relative rotation therebetween, the inner body including a second outer generally-cylindrical surface proximate the second end thereof having an outer diameter smaller than that of the first outer generally-cylindrical surface, the second generally-cylindrical surface being spaced radially inward from the internal annular wall; and c. a sealing member disposed about the inner body generally proximate the second end thereof and engaged with the internal annular wall of the outer shield for preventing moisture from passing along the internal annular wall of the outer shield from the second end of the inner body toward the first end of the inner body.

15. The tamper resistant coaxial terminator recited by claim 14 wherein an annular recess is formed within the second outer generally-cylindrical surface of the inner body, and wherein the sealing member is retained within the annular recess.

16. The tamper resistant coaxial terminator recited by claim 11 wherein the first end of the outer shield has an enlarged internal diameter for creating an annular space between the first end of the inner body and the surrounding first end of the outer shield, the tamper resistant coaxial terminator further including a generally tubular seal for extending around the externally-threaded outer conductor of the coaxial equipment port, a generally tubular seal extending between first and second opposing ends, the first end of the generally tubular seal being adapted to engage a surface of the equipment box, and a second end of the generally tubular seal extending within the annular space between the first end of the outer shield and the first end of the inner body.

17. The tamper resistant coaxial terminator recited by claim 16 wherein the enlarged internal diameter provided at the first end of the outer shield includes a beveled surface for compressing the second end of the generally tubular seal inwardly toward the first end of the inner body as the terminator is tightened over the coaxial equipment port.

18. The tamper resistant coaxial terminator recited by claim 11 wherein the inner body and the RF port member are each made of metal, and wherein the RF port member is press-fit into the inner body.

19. The tamper resistant coaxial terminator recited by claim 18 wherein the RF port member includes an outwardly-beveled surface to outwardly deform the radially deformable region of the inner body as the RF port member is press fit into the inner body for extending the outwardly projecting annular rib into the annular recess of the outer shield to rotatably secure the inner body within the outer shield.

20. The tamper resistant coaxial terminator recited by claim 11 including a deforming member press-fit inside the central bore of the inner body, the deforming member extending within the deformable region of the inner body.

21. The tamper resistant coaxial terminator recited by claim 20 wherein the deforming member is an electrically-conductive RF port member, the inner body and the RF port member being coupled to each other for rotating as a unit.

22. The tamper resistant coaxial terminator recited by claim 21 wherein the RF port member has a central bore extending therein, and wherein said terminator further includes a resistor housed within the RF port member and having first and second ends, the first end of the resistor including a central pin extending from the central bore of the RF port member for being inserted within the female center conductor of the coaxial equipment port, the second end of the resistor being electrically coupled to the RF port member.

* * * * *